US009784108B2

(12) United States Patent
Bekking

(10) Patent No.: US 9,784,108 B2
(45) **Date of Patent: *Oct. 10, 2017**

(54) ROTARY MACHINE FOR COMPRESSION AND DECOMPRESSION

(71) Applicant: Be-Kking Management B.V., GL Ede Gld (NL)

(72) Inventor: Wilhelmus Theodorus Clemens Bekking, GL Ede (NL)

(73) Assignee: Be-Kking Management B.V., Ede (NL)

( * ) Notice: Subject to any disclaimer, the term of this patent is extended or adjusted under 35 U.S.C. 154(b) by 16 days.

This patent is subject to a terminal disclaimer.

(21) Appl. No.: 14/737,083

(22) Filed: Jun. 11, 2015

(65) Prior Publication Data

US 2015/0275668 A1 Oct. 1, 2015

Related U.S. Application Data

(63) Continuation of application No. 13/807,507, filed as application No. PCT/NL2011/050475 on Jul. 1, 2011, now Pat. No. 9,074,602.

(30) Foreign Application Priority Data

Jul. 1, 2010 (NL) ..... 2005011

(51) Int. Cl.
*F01C 3/08* (2006.01)
*F04D 19/00* (2006.01)

(52) U.S. Cl.
CPC ..... *F01C 3/085* (2013.01); *F04D 19/00* (2013.01)

(58) Field of Classification Search
CPC .. F04D 19/00; F01C 3/085; F01C 1/44; F01C 3/06; F01C 9/002; F01C 9/005;
(Continued)

(56) References Cited

U.S. PATENT DOCUMENTS 826,985 A 7/1906 Appel
3,549,286 A 12/1970 Moriarty
(Continued)

FOREIGN PATENT DOCUMENTS

DE 2608479 A1 9/1977
DE 4325166 A1 2/1995
(Continued)

OTHER PUBLICATIONS

Translation—Description WO 2011147492 A2, Oct. 13, 2014, entire document.

(Continued)

*Primary Examiner* — Phutthiwat Wongwian
*Assistant Examiner* — Jason T Newton
(74) *Attorney, Agent, or Firm* — NLO N.V.; Catherine A. Shultz; Minerva Rivero

(57) ABSTRACT

A rotary machine for compression and decompression, comprising a disc-shaped rotor having a first rotation axis at right angles to the plane of the rotor and situated in a plane of orientation and a disc-shaped swing element having a second rotation axis. In the orientation plane, the second rotation axis makes an angle with the first rotation axis. Furthermore, a spherical housing is present surrounding the rotor and the swing element and in combination forming four (de-)compression chambers. A connecting body positions the rotor and the swing element in the housing. The rotary machine furthermore comprises a power drive and a mechanical connection delivering power to or taking off power from the rotary machine. In addition, the rotary machine is suitable for the seamless integration of generator components for generating or using electricity.

21 Claims, 8 Drawing Sheets

(58) Field of Classification Search
CPC .. F01C 1/3442; F02B 53/00; F02B 2075/025; F02B 2075/027; F04C 15/06
USPC ..... 415/1, 185; 123/212, 241, 245, 18 R; 418/68, 32, 70
See application file for complete search history.

(56) References Cited

U.S. PATENT DOCUMENTS

| | | | |
|---|---|---|---|
| 4,024,841 | A | 5/1977 | Smith |
| 4,634,889 | A | 1/1987 | Foggia et al. |
| 4,721,079 | A | 1/1988 | Lien |
| 4,938,025 | A | 7/1990 | Larsen |
| 5,147,193 | A | 9/1992 | Larsen |
| 5,199,864 | A | 4/1993 | Stecklein |
| 5,204,570 | A | 4/1993 | Gerfast |
| 5,410,232 | A | 4/1995 | Lee |
| 6,442,935 | B1 | 9/2002 | Larsen |
| 7,457,115 | B2 | 11/2008 | Farrow |
| 8,202,070 | B2 | 6/2012 | Didin et al. |
| 2013/0084196 | A1 | 4/2013 | Huettlin |

FOREIGN PATENT DOCUMENTS

| | | | |
|---|---|---|---|
| DE | 19616125 | A1 | 10/1997 |
| GB | 2052639 | A | 1/1981 |
| JP | 2001355401 | A | 12/2001 |
| JP | 2008223752 | A | 9/2008 |
| WO | 9743520 | A1 | 11/1997 |
| WO | 9859411 | A1 | 12/1998 |
| WO | 2006067588 | A1 | 6/2006 |
| WO | 2011147492 | A2 | 12/2011 |

OTHER PUBLICATIONS

Translation Description DE 26 08 479, Feb. 16, 2014.
JP 2001-355401 Description Machine Translation, Feb. 16, 2014.

ROTARY MACHINE FOR COMPRESSION AND DECOMPRESSION

CROSS REFERENCE TO RELATED APPLICATIONS

This application is a continuation of U.S. application Ser. No. 13/807,507, which was filed Jan. 31, 2013 and was a 35 U.S.C. §371 national stage of PCT/NL2011/050475, which was filed Jul. 1, 2011 and claimed priority to NL 2005011, filed Jul. 1, 2010, all of which are incorporated herein by reference as if fully set forth.

FIELD OF THE INVENTION

The present invention relates to a rotary machine for compression and decompression and the construction of compact (electrical) pumps, compressors, turbines, combustion engines and generators.

PRIOR ART

British patent GB-A-2 052 639 describes a rotary machine which generates varying volumes and which can be used as an internal combustion engine or pump. The machine comprises a spherical housing which is provided with ports, inside which a rotating plate and a cylindrical disc with integrated shaft are placed. The respective axes of rotation of the rotating plate and the cylindrical disc are at an angle with respect to one another. In each case two chambers are formed on either side of the rotating plate, the volume of which varies as the cylindrical disc rotates about the shaft. The rotating plate and cylindrical disc can slide with respect to one another by means of sliding blocks.

German patent DE-26 08 479 discloses a motor/pump having a spherical shape. The entire description is based on a single motor shaft O which is used for the input/output of power. Inlet and outlet parts of the motor are incorporated in the stationary parts of the motor.

Japanese patent JP-A-2001 355401 discloses a rotating motor having a spherical shape. It also shows inlets, outlets and an ignition. The shaft on which the reciprocating disc rotates is used for driving or for taking off power.

International patent WO2006/067588 describes an artificial heart having a disc-shaped rotating shutter, a disc-shaped oscillating shutter which is connected to the rotating shutter via a hinged connection in the plane of both shutters, and a guide ring which is connected to the oscillating shutter. The artificial heart can be driven via the guide ring by means of a motor or using induced muscle contraction.

SUMMARY OF THE INVENTION

It is an object of the present invention to provide a rotary machine which is compact, can operate with a high degree of efficiency and can be readily produced.

According to the present invention, a rotary machine of the kind described in the preamble is provided, comprising:

- a disc-shaped rotor having a first rotation axis which is at right angles to the plane of the rotor and is situated in an orientation plane;
- a substantially disc-shaped swing element having a second rotation axis which is situated in the plane of the disc-shaped swing element and in the orientation plane, wherein the second rotation axis makes an angle (a) with the first rotation axis in the orientation plane;

- a substantially spherical housing which surrounds the rotor and the swing element and, in combination therewith, forms four (de)compression chambers;
- a connecting body which positions the rotor and the swing element slidably with respect to one another in the housing, and seals the four (de)compression chambers;

wherein the device is furthermore provided with a power drive and a mechanical connection (for example a gear wheel, belt, etc. . . . ) between the power drive and the rotor, wherein the power drive is configured to deliver power to the rotary machine or to take off power from the rotary machine.

In a further aspect, the present invention relates to a method for operating a rotary machine according to one of the embodiments described here, comprising taking off power from or delivering power to the rotary machine via the disc-shaped rotor.

Due to the uniform movement of the rotor, power can efficiently be taken off from or delivered to the rotary machine. This configuration can be used as a turbine, compressor, pump or combustion engine. By means of the embodiments of the present invention, smaller systems are possible and a higher efficiency is achieved than is the case with the present rotary machines which are provided with a crankshaft or operate according to the Wankel principle.

BRIEF DESCRIPTION OF THE DRAWINGS

The present invention will now be described in more detail by means of a number of exemplary embodiments with reference to the attached drawings, in which.

DETAILED DESCRIPTION OF EXEMPLARY EMBODIMENTS

The embodiments of the rotary machine according to the present invention can be described using a new three-dimensional mechanism which makes compact and efficient compression and decompression possible. The mechanism uses a spherical shape, translation and rotation and has been named STaR mechanism (Spherical Translation and Rotation). In addition, the method for operating the various embodiments of the STaR mechanism is described.

After the description of the new STaR mechanism, further embodiments with added inlet, flush and outlet ports are also elaborated on. In combination with the STaR mechanism, they form the basis for the construction of a new generation of turbines, compressors, pumps, combustion engines and generators.

As has been indicated above, the STaR mechanism can inter alia be used as an efficient replacement for the current piston/crankshaft and Wankel constructions. The advantages of the new STaR mechanism compared to the current piston/crankshaft engines are, inter alia:

1. Compact, small dimensions, thus making it possible to construct smaller engines.

2. Energy transfer between the components is reduced as use is made of rotation. This makes lighter components and/or higher rotary speeds possible.

3. Low in vibrations, rotation largely avoids the customary shaking and vibrating of current engines.

The additional advantages of the new STaR mechanism compared to the Wankel engines are:

A. There are no punctiform connections between the rotary piston and the drum wall which could cause leaks.

B. The shape of the combustion chamber enables quick expansion and thus prevents high temperatures and related heat and energy losses.

The embodiments of the present invention are able to achieve a higher efficiency than the current combustion engines.

The STaR mechanism described in this application may incorporate generator elements. The stator or the stationary part of the generator may be incorporated in the STaR housing. The rotor or the rotating part of the generator may be incorporated in the STaR rotor.

By driving the STaR mechanism by, for example, gas or liquid streams and/or combustion, electrical power can be generated by rotation of the rotor. Conversely, the rotor of the STaR mechanism can also be driven by electrical power. Thus, it is for example possible to construct a compact pump or compressor.

An exemplary application in which both forms are used is a STaR combustion engine to which the stator and rotor elements have been added. This makes it possible to start the engine, after which electrical power can be taken off which is ideal for the construction of, for example, a compact Range Extender.

Figure 1:
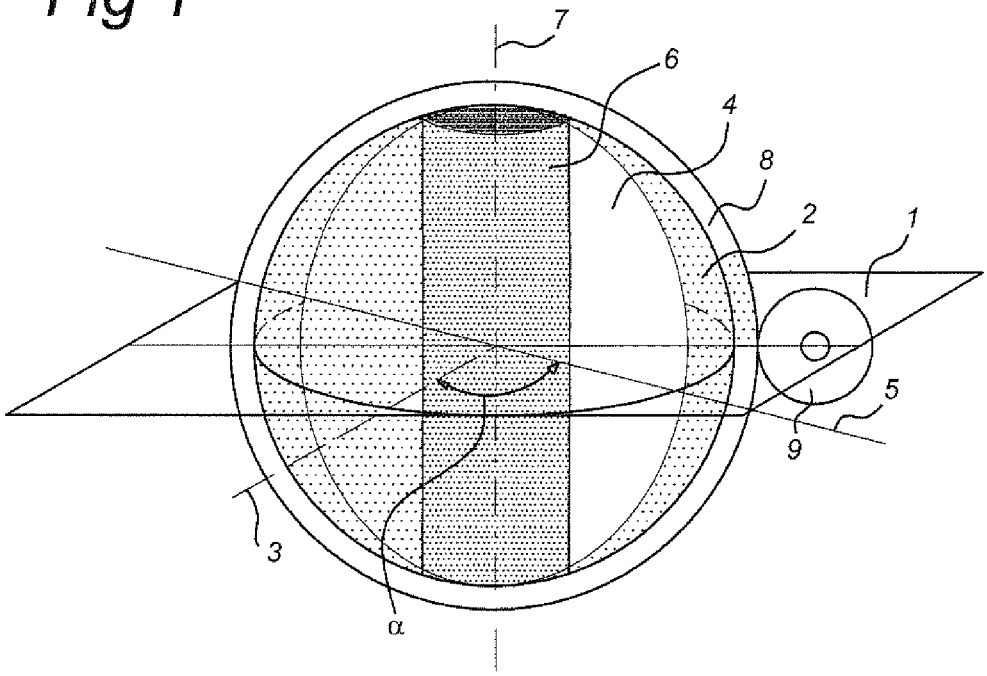
FIG. 1 shows a cut-away perspective view of an embodiment of the rotary machine according to the present invention.
Figure 2:
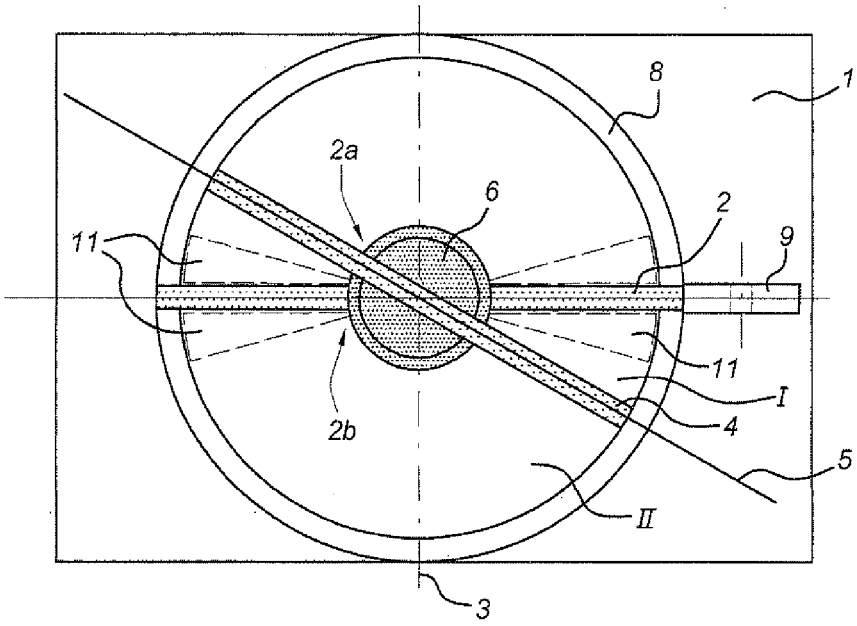
FIG. 2 shows a top view of the rotary machine from FIG. 1.

FIG. 1 shows a three-dimensional view of a first embodiment of the rotary machine, and FIG. 2 shows a sectional view. The basic principle of the three-dimensional STaR mechanism is formed by two interacting discs 2, 4 which both rotate in a spherical manner. A disc-shaped rotor 2 (also referred to as rotor disc in the remainder of this description) and a substantially disc-shaped swing element 4 (also referred to as swinger disc in the remainder of the description) each have an individual rotation axis (first rotation axis 3 and second rotation axis 5, respectively, see below) and are connected to one another by means of a connecting body 6 (also referred to as joiner in the remainder of the description) in order to prevent leakage points. The assembly is enclosed in a substantially spherical housing 8 which surrounds the rotor 2 and the swing element 4 and, in combination therewith, forms four (de)compression chambers. The mechanism, together with the housing 8, the rotor disc 2, the swinger disc 4 and the joiner 6 forms a total of four rotating compression/decompression chambers and is suitable for constructing compact and efficient turbines, compressors, pumps and motors.

For illustrative purposes, FIG. 1 shows an orientation plane 1 which is also the plane of the drawing in the sectional view from FIG. 2. The rotor disc 2 rotates about an (imaginary) first rotation axis 3 which is at right angles to the plane of the disc-shaped rotor 2 and is situated in the orientation plane 1. The rotor disc 2 is provided with an aperture in the centre which accommodates the joiner 6 which couples the rotor disc 2 and the swinger disc 4 with one another. The swinger disc 4 rotates about a second rotation axis 5 which is situated in the plane of the swinger 4 itself and in the orientation plane 1, with the second rotation axis 5 making an angle $\alpha$ with the first rotation axis 3 in the orientation plane 1. The plane of the swinger disc 4 has a solid surface and intersects the rotor disc 2.

The disc-shaped rotor 2 and disc-shaped swing element 4 are connected to one another by means of the joiner 6 in order to prevent leaks between the various (de)compression chambers. The joiner positions the rotor 2 and swing element 4 in the housing 8 so as to be slidable with respect to one another. In the embodiment shown in FIGS. 1 and 2, the joiner 6 is rotationally symmetrical with a rotation axis 7 which is situated in the plane of the rotor 2. The joiner 6 is intersected by the swinger disc 4 and comprises, for example, two identical parts on either side of the swinger disc 4.

The assembly is enclosed by the spherical housing 8 and four chambers are formed which, upon rotation of the rotor disc 2, the joiner 6 and the swinger disc 4, successively expand and compress. The compression ratio is determined by the angle $\alpha$ between the rotor axis 3 and the swinger axis 5, the thickness of the rotor disc 2, the thickness of the swinger disc 4 and the diameter of the joiner 6.

The centres of gravity of the rotor disc 2, the swinger disc 4 and the joiner 6 are situated in the centre of the enclosing housing 8. This prevents pressure and friction on the coupling faces due to the centrifugal forces caused by the rotations.

The thickness of the discs 2, 4 and the thickness of the wall of the joiner 6 can be chosen arbitrarily, they adjoin one another across the entire width and form no punctiform connections which could form potential leaks upon compression and decompression.

In the embodiment illustrated in FIGS. 1 and 2, the connecting body 6 is a substantially cylindrical body having a longitudinal axis 7. The connecting body 6 is provided with a slot-shaped (or rectangular) opening 2*a* for slidably accommodating the swing element 4 therein (as is illustrated in FIG. 2), and with an outer surface which is coaxial with the longitudinal axis 7 and in slidable contact with the rotor 2. In this embodiment, the rotor 2 is to this end provided with a rectangular opening 2*b* in which the connecting body 6 can move. The longitudinal axis 7 of the connecting body 6 is in the plane of the rotor 2. As has already been mentioned above, the connecting body 6 ensures a good and reliable sealing of the (de)compression chambers. The finite dimensions of the various elements result in planar seals instead of punctiform seals (such as for example in Wankel engines). The connecting body 6 in the spherical housing 8 co-rotates with the rotor 2. In the embodiment illustrated in FIGS. 1 and 2, the ends of the connecting body 6 comprise annular faces having a curvature which is identical to the internal curvature of the housing 8.

Due to the mutual (slidable) connections between the rotor 2, swing element 4 and connecting body 6, and the fixedly oriented first and second orientation axes 3, 5, the joiner 6 which is fitted in the rotor plane is carried along upon rotation of the rotor 2 in its rotor plane. The joiner 6 in turn carries along the swinger disc 4. In this case, the joiner 6 rotates about its own shaft 7 and slides the swinger disc 4 through the joiner 6 and thus through the rotor plane. In this way, two chambers are formed on each side of the rotor 2, with compression and expansion taking place alternately upon rotation, in accordance with the following table:

| Rotor position in degrees | Chamber II (see FIG. 2) | Chamber I (see FIG. 2) |
|---|---|---|
| 000-090 | Compression | Expansion |
| 090-180 | Compression | Expansion |
| 180-270 | Expansion | Compression |
| 270-360 | Expansion | Compression |

By making use of the compact STaR mechanism and by incorporating the stator and rotor elements in the housing and rotor, compact electrical STaR systems are produced using the rotor as drive means. By contrast, when using the swinger axis (second rotation axis 5) for couplings with other apparatus, individual systems with individual functions are produced which take up more space.

In addition, in classical mechanics, the rotor disc 2 is preferred over the swinger disc 4 for driving purposes. The below formulae show that acceleration and deceleration of the swinger disc 4 require less energy transfer and therefore cause less energy transfer between the components. As a result of this choice, lighter constructions and/or higher rotary speeds are possible.

Rotor disc 2 for driving in the basic STaR version:

The moment of inertia of the rotor disc 2 which rotates about a symmetry axis (first rotation axis 3) which is at right angles to its own plane:

$$I=\tfrac{1}{2}*M*R^2$$

The moment of inertia of the swinger disc 4 which rotates about a symmetry axis (second rotation axis 5) which is situated in its own plane:

$$I=\tfrac{1}{4}*M*R^2+\tfrac{1}{12}*M*D^2$$

In the formulae, I represents the moment of inertia, M stands for the mass, R denotes the radius and D the thickness of a disc 2, 4.

The thickness D is smaller than the radius R and therefore the moment of inertia of the swinger disc 4 is slightly more than half that of the rotor disc 2.

The compression ratio is determined by the angle α between the imaginary rotor axis 3 and the swinger axis 5, the thickness of the rotor disc 2, the thickness of the swinger disc 4 and the diameter of the joiner 6. The angle α should not become too large because of the magnitude of the energy transfer between the rotor disc 2, the swinger disc 4 and the joiner 6.

In order to be able to achieve sufficiently great compression at a limited angle α, it is necessary to reduce the volume of the chambers by the same value. This can be effected in various ways:

by widening of the rotor disc 2;

by radial extension of the rotor disc 2;

by capping the swinger disc 4 and the surrounding inside of the housing 8 on the outside of the swinger axis 5.

As yet, radial extension without capping is preferred, because the effective contact surface with the fuel mixture at the time of combustion is larger then.

As a result of these considerations, the rotary machine according to the embodiments of the present invention is therefore also provided with a power drive 9 which has a mechanical connection (such as a gear wheel, drive belt, etc.) with the rotor 2, and which takes care of the delivery of power to or the take-off of power from the rotary machine. In FIG. 1, the power drive 9 is shown as a wheel which engages with the outer edge of the rotor 2 (which in this case extends through the housing 8, in any case at the location of the power drive 9). However, the power drive can in general be an element which is mechanically connected to the rotor 2. There are many possible ways of driving/power delivery and the power drive 9 may, for example, be configured with a belt around the rotor 2 or a right-angled toothing. As a result of the uniform movement of the rotor 2, simple input and take-off of power is possible.

It can furthermore be deduced from the above formulae that, for a rotary machine to be efficient, the angle α should not be excessively large because of the kinetic energy transfer from and to the swinger disc 4 and the joiner 6 as a result of the rotation accelerations and decelerations. By way of example, the angle α is smaller than 80°. In a further embodiment, the angle α can be adjusted during operation, as a result of which the characteristic of the rotary machine can be adjusted, for example can be optimized on the basis of the current operating conditions.

In further embodiments of the present invention, an adjustment is made in order to achieve a sufficiently great compression at a limited angle α. This is achieved by reducing the volume of the chambers, for example by means of volume-reducing elements 11. In one variant, this can be achieved by increasing the thickness of the rotor disc 2 across the entire surface of the rotor 2, and in another variant by extending the rotor 2 in the radial direction. In addition, in both variants, additional compression caps 11 may be used as an embodiment of the volume-reducing elements 11 in each of the compression chambers which are attached either to the rotor 2 (as is indicated by dashed lines in FIG. 2) or to the swing element 4. The variant with the radial extension of the rotor 2 and optional compression caps has the advantage that the effective contact surface and moment for energy transfer at the moment of combustion is greater.

Further modifications can be made to the spherical shape of the housing 8. In an embodiment, the spherical housing 8 is flattened along the second rotation axis 5, with the swing element 4 being adjusted accordingly. The flattening of the spherical housing 8 may continue up to the rotor 2, at right angles to the second rotation axis 5. The adjustment of the shape of the housing 8 may be asymmetrical with respect to the rotor 2, as a result of which two pairs of compression chambers having different properties are formed.

In the embodiments described with reference to FIGS. 1 and 2, the basic principle of the STaR mechanism is described. As a result of the uniform movement of the rotor 2, the swinger disc 4 and the joiner 6 are subject to accelerations and decelerations, which results in (limited) kinetic energy transfer.

A further optimization of the rotary machine is achieved in a further embodiment with uniform rotation of the swinger disc 4. This can be achieved by means of a one-to-one (mechanical) coupling of the rotor axis 3 and the swinger axis 5, for example by using correctly dimensioned axles, gear wheels and transmissions. The kinetic energy transfer and the related power loss are now limited to the joiner 6 which follows the rotor 2 and swinger disc 4. In this case, the joiner 6 rotates not only in the plane of the rotor 2 in order to be able to follow the swinger disc 4, but the joiner 6 now also slides in the plane of the rotor 2 about the first rotation axis 3 in order to enable the uniform rotation of the swinger disc 4.

Figure 3:
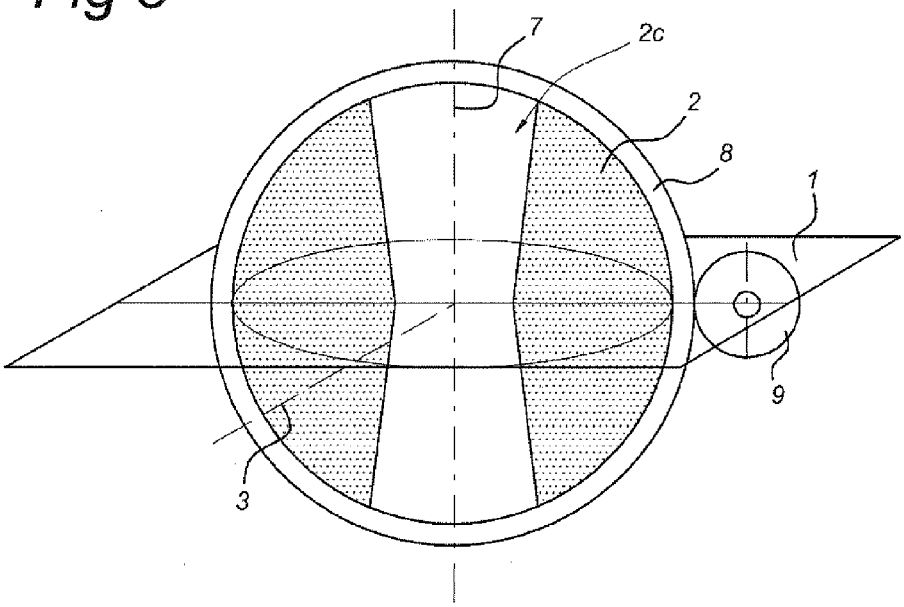
FIG. 3 shows a perspective view of a part of a further embodiment of the present rotary machine.

FIG. 3 shows a simplified perspective view of a part of the rotary machine according to this embodiment. Again, the orientation plane 1 in which the first rotation axis 3 of the rotor 2 is situated has been illustrated. The rotor disc 2 again rotates about an (imaginary) first rotation axis 3 which is at right angles to the plane of the rotor 2. In the centre of the rotor 2, an opening 2*c* is provided in which the connecting body (joiner) 6 can be accommodated. The opening 2*c* is substantially in the shape of an hourglass, as a result of which the connecting body can reciprocate around the first rotation axis 3 of the rotor 2 (that is to say the longitudinal axis 7 of the connecting body 6 can reciprocate in the plane of the rotor 2). In an example, the hourglass shape tapers by 7°. Further embodiments have tapering shapes at an angle between 5° and 10°.

Figure 4:
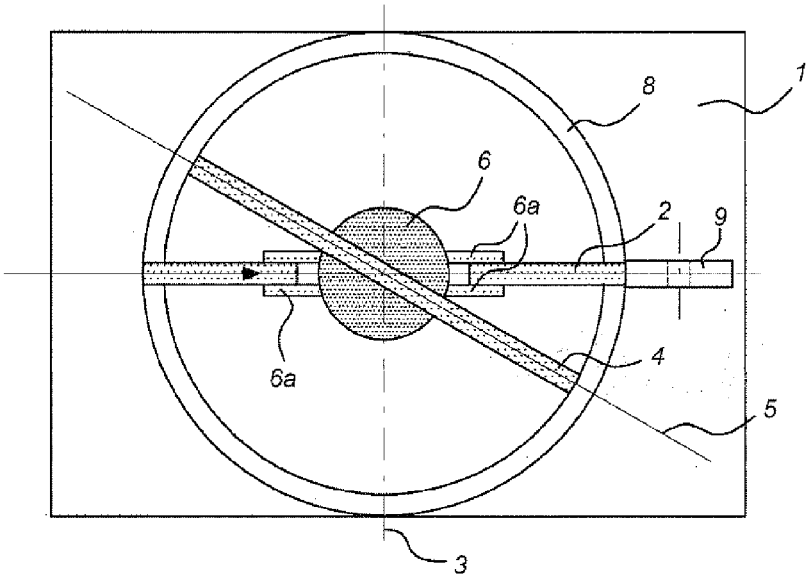
FIG. 4 shows a complete top view in cross section of the rotary machine from FIG. 3.

The joiner 6 again connects the rotor disc 2 and the swinger disc 4 to one another. The swinger disc 4 rotates about the second rotation axis 5 which is situated in the disc plane of the swinger disc 4 itself. FIG. 4 shows a view in cross section along the orientation plane 1 in which all elements of the rotary machine are visible. As is the case in the above-described embodiments, the swinger disc 4 has a solid surface and intersects the rotor 2. The rotor axis 3 and the swinger axis 5 are both in the orientation plane 1 and the angle between the rotor axis 3 and the swinger axis 5 is indicated by the angle α.

In this embodiment, the joiner 6 rotates in the plane of the rotor 2 so as to be able to follow the swinger disc 4. The joiner 6 also slides in the plane of the rotor 2 in order to be able to follow the uniform rotation of the swinger disc. In order to make this possible, the joiner 6 is provided with four (or two, depending on the drawing) flanges 6*a* which slidingly overlap part of the plane of the rotor 2. This ensures a satisfactory sealing between the four compression chambers of the rotary machine.

In this embodiment, the volume-reducing elements 11 can also be present and be configured in a similar way to the embodiment from FIGS. 1 and 2. In a further embodiment, the volume-reducing elements 11 can be integrated with the flanges 6*a*, and be formed as a single element.

In this embodiment as well, the compression ratio is determined by the angle α between the rotor axis 3 and the swinger axis 5, the thickness of the rotor disc 2, the thickness of the swinger disc 4 and the diameter of the joiner 6.

Using additional elements, the STaR mechanism is thus suitable to also deliver or take off power via the uniformly moving swinger axis 5. A rotary machine is then provided for compression and decompression, comprising:

- a disc-shaped rotor 2 having a first rotation axis 3 which is at right angles to the plane of the rotor 2 and is situated in an orientation plane 1;
- a substantially disc-shaped swing element 4 having a second rotation axis 5 which is situated in the plane of the disc-shaped swing element 4 and in the orientation plane 1, wherein the second rotation axis 5 makes an angle α with the first rotation axis 3 in the orientation plane 1;
- a substantially spherical housing 8 which surrounds the rotor 2 and the swing element 4 and, in combination therewith, forms four (de)compression chambers;
- a connecting body 6 which positions the rotor 2 and the swing element 4 slidably with respect to one another in the housing 8, and seals the four (de)compression chambers;
- wherein the rotor 2 is provided with a substantially hourglass-shaped opening 2*c* in which the connecting body 6 is accommodated so as to be movable, and wherein the device is furthermore provided with a power drive 9 and a mechanical connection between the power drive 9 and the swing element 4 (with the second rotation axis 5), wherein the power drive is configured to deliver power to the rotary machine or to take off power from the rotary machine.

As is the case with the embodiment which has been described with reference to FIGS. 1 and 2, a number of variants are possible, such as varying the compression ratio. An advantage of the embodiments described with reference to FIGS. 3 and 4 is that both the rotor disc 2 and the swinger disc 4 are suitable for embodying port constructions for the supply of fluids to and the discharge of fluids from the compression chambers. In the embodiments described with reference to FIGS. 1 and 2, the swinger disc 4 is less suitable for additions for constructing ports, as this adversely affects the moment of inertia and the kinetic energy transfer, which is in contrast with the rotor 2 as this rotates uniformly.

In the above-described embodiments, three components have been used, i.e. a rotor disc 2, a swinger disc 4 and a joiner 6. The STaR mechanism also makes it possible to combine these components. Thus, there are two instead of three moving components and therefore fewer leakage points.

Figure 5:
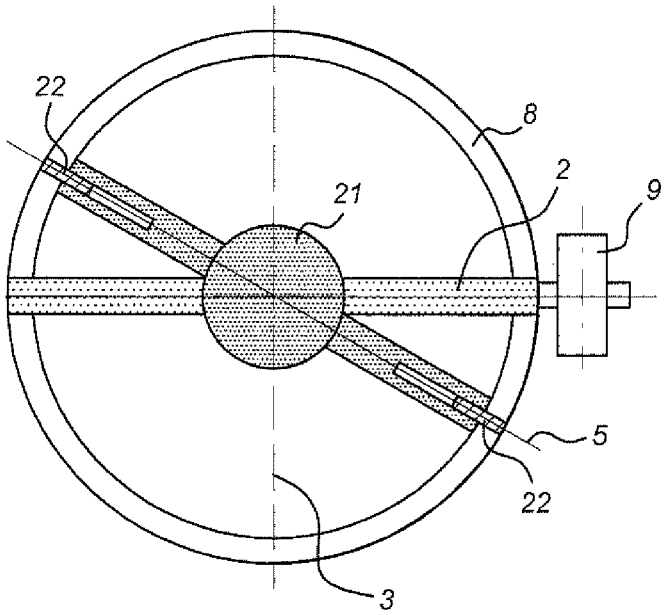
FIG. 5 shows a top view of a further embodiment of the rotary machine with an integrated swing element.
Figure 6:
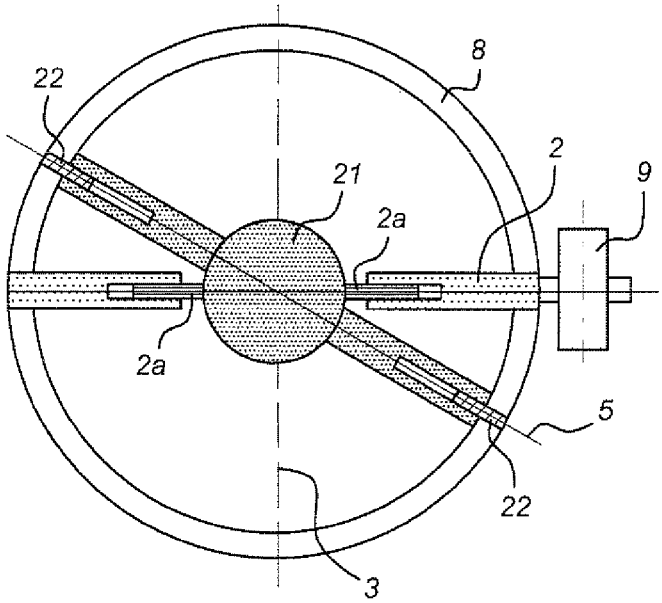
FIG. 6 shows a top view of a variant of the embodiment from FIG. 5.

FIGS. 5 and 6 show a view of two further embodiments in which the swinger disc 4 is combined with the joiner 6 to form a single integrated swing element 21 which is rotatable with respect to the rotor 2. In this construction, the swinger disc part of the single swing element 21 rotates about the swinger axis 5. As the swinger disc 4 no longer slides through the joiner 6, the latter now also has to slide across its own swinger axis 5. In FIGS. 5 and 6, this has been shown for the basic configuration (cf. FIG. 2) and the optimized configuration (cf. FIG. 3), respectively. Axle journals 22 in the housing 8 which engage in a corresponding slot in the swinger disc part of the single swing element 21 suffice and a fully physically continuous swinger axis is not necessary.

The embodiment from FIG. 6 also shows that the rotor 2, in combination with the modified joiner 6, may be provided with guides 2*a* which can move in a space in the rotor 2 in order to absorb 9 the (translational) movement of the single swing element 21 as an alternative to the flanges 6*a* of the embodiment from FIG. 3.

Figure 7:
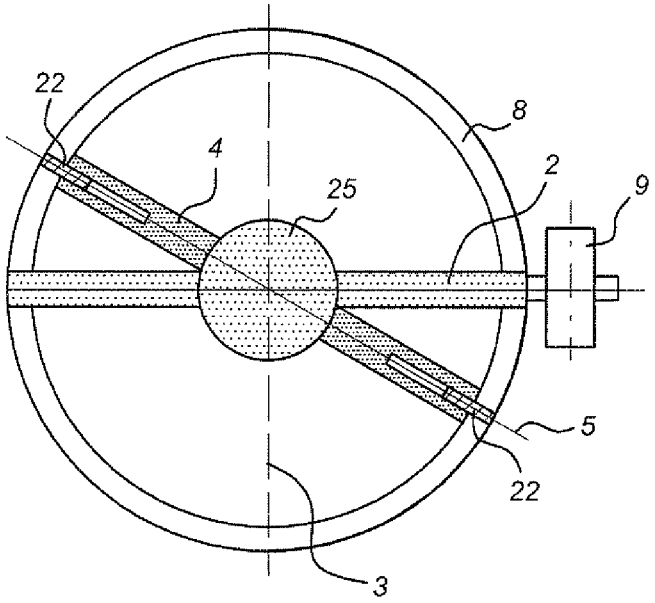
FIG. 7 shows a top view of a further embodiment of the rotary machine with an integrated rotor element.
Figure 8:
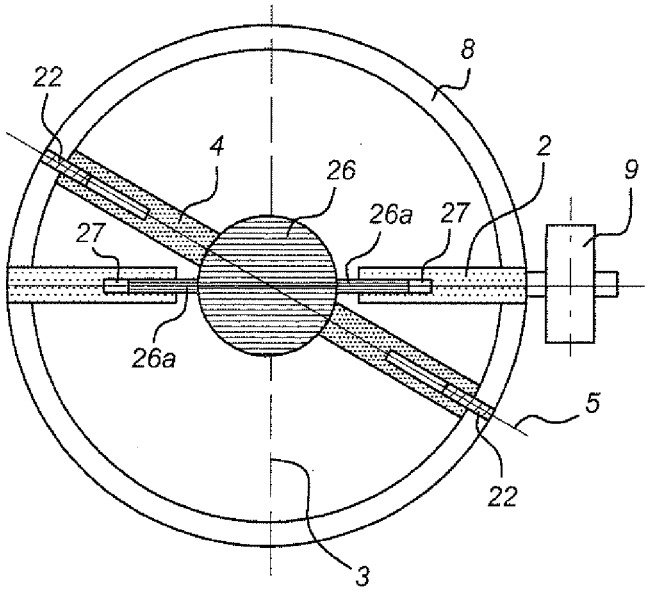
FIG. 8 shows a top view of a variant of the embodiment from FIG. 7.

FIGS. 7 and 8 show a view of two further embodiments, in which the rotor disc 2 is combined with the joiner 6 to form a single integrated rotation element 25. In this construction, the swinger disc 4 rotates about the single rotation element 25 (the joiner/rotor combination). As the swinger disc 4 no longer slides through the joiner 6, it also has to slide across its own swinger axis 5. In FIGS. 7 and 8, this has again been shown for the basic configuration (see FIG. 2) and the optimized configuration (see FIG. 3). Axle journals 22 provided in the housing 8 which engage in a slot in the swinger disc 4 suffice and a continuous swinger axis is not necessary.

Figure 9:
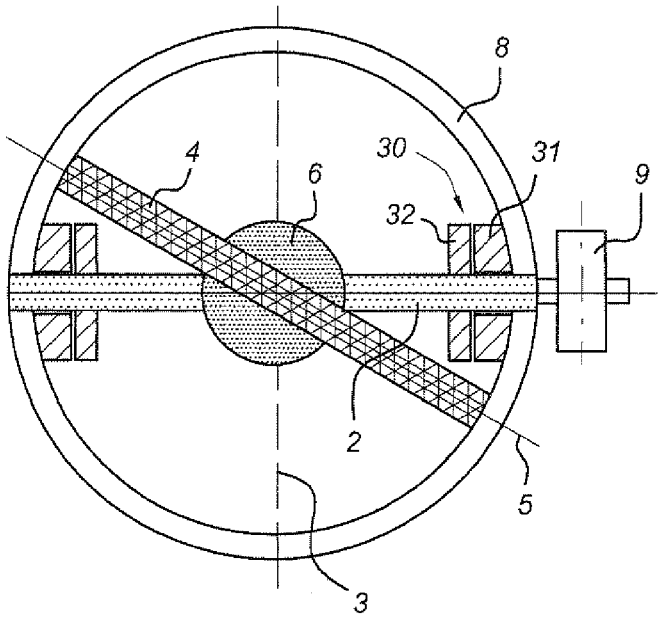
FIG. 9 shows a top view of an embodiment with a generator.

FIG. 9 shows a further embodiment of the rotary machine according to the present invention, in which the rotary machine furthermore comprises a generator 30. The generator 30 can be used in conjunction with the rotary machine for generating electrical power (for example via the power drive 9 illustrated in FIGS. 1 and 2). Alternatively, the generator 30 can be used to drive the rotary machine. According to an embodiment, one or more elements of the generator 30 are integrated with the rotary machine, as is shown in the embodiment from FIG. 9. In this embodiment, the generator 30 comprises a stator part 31 and a rotor part 32, with the rotor part 32 being driven via the rotor 2 and the stator part 31 being attached to the housing of the rotary machine.

Obviously, the stator part 31 and the rotor part 32 can also be positioned on the outside of the housing 8. In the embodiment illustrated in FIG. 9, the stator part 31 and the rotor part 32 can also serve as alternative volume-reducing elements 11, as has been described above.

As the person skilled in the art will know, the generator 30 can be configured in many ways, with variations in magnetic and electromagnetic poles for the stator part 31 and rotor part 32, and variations in the numbers of poles.

Figure 10:
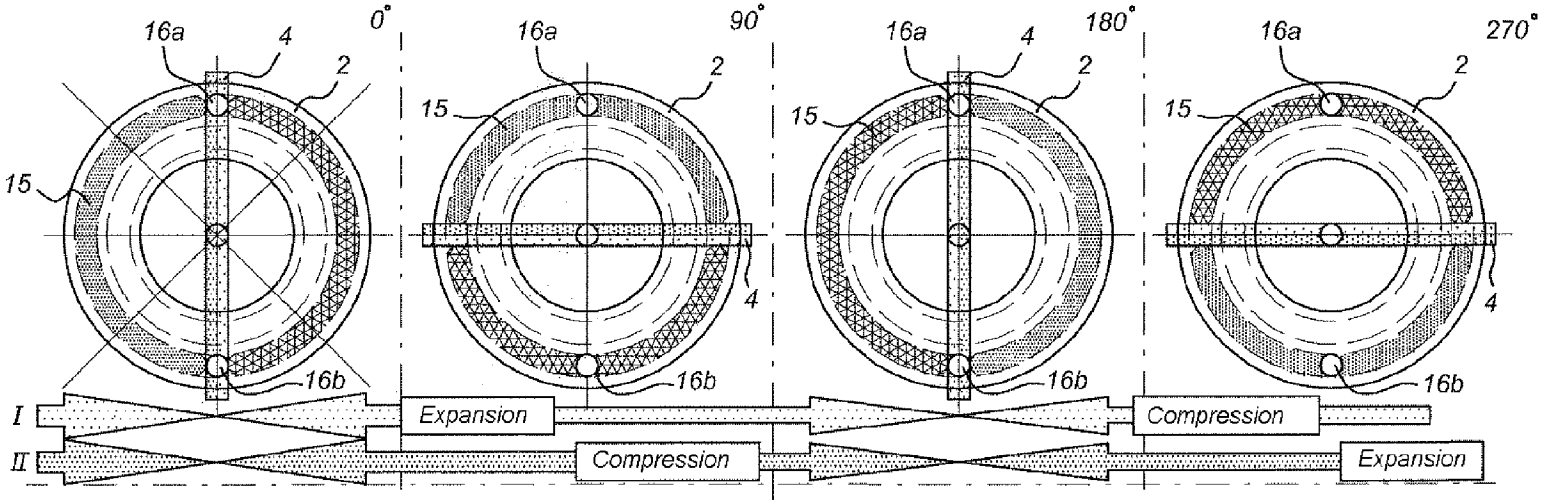
FIG. 10 shows a state diagram of compression and decompression in a rotary machine according to the present invention.

FIG. 10 shows a state diagram of various ports when using the rotary machine as a turbine, compressor or pump. In this embodiment, two ports 16 are provided in the enclosing housing 8, one inlet port 16*b* and one outlet port 16*a*. Corresponding slots in the rotating port belt 15 open and close the inlet port 16*b* and the outlet port 16*a*. The two chambers alternately use the inlet port and the outlet port, and compression and expansion take place in opposite turns in the chambers, as is indicated by Roman numerals I and II. When a chamber has reached its minimum volume, the inlet port opens. As a result of excess pressure, the chamber will expand and rotary energy is produced. When the chamber has reached its maximum volume, the inlet port closes and the outlet port opens to allow the excess pressure to escape, following which the cycle starts again. In conjunction with FIG. 7, the table below gives the state of the two chambers, for every 90 degrees of the rotor 2 (i.e. at 0°, 90°, 180° and 270° for the four positions illustrated in FIG. 7).

| Position in degrees | Chamber I | Chamber II |
|---|---|---|
| 000 | start of expansion | start of compression |
| 090 | expansion | compression |
| 180 | end of expansion<br>start of compression | end of compression<br>start of expansion |
| 270 | compression | expansion |
| 360 | end of compression → 000 | end of expansion → 000 |

The two chambers on one side of the rotor 2 follow the same pattern and are 180 degrees out of phase. Since the rotary machine with STaR mechanism comprises a total of four chambers, a four-chamber turbine is thus produced which can be used in, for example, a steam engine or a steam train. It operates in a symmetrical way. Due to the excess pressure on the inlet port, rotary energy is produced. In this embodiment, power is delivered to one or more of the ports 16 and the power drive 9 is configured to take off power from the rotary machine.

Conversely, if the rotor 2 is set in motion by an external source of power (via the drive 9, see the description of the embodiment with reference to FIGS. 1 and 2), volume is sucked in and discharged and a compressor or a pump is created. In this embodiment, the power drive 9 is configured to drive the rotor, as a result of which power is generated on the one or more ports.

In a specific embodiment, the port belt 15 is connected to the swinger disc 4. Here, the width of the ports 16 was chosen to be equal to the thickness of the swinger disc 4. As a result of this choice, the slots occupy the entire width of the chambers and holes in the enclosing housing 8 suffice. If this configuration is used for the construction of a turbine, one port 16 is provided for supplying the excess pressure and the other port 16 for discharging it.

In further embodiments, the rotary machine is used as a combustion engine. In a first variant, a combustion engine with one working stroke per revolution of the rotor 2 is produced. This application of the STaR mechanism is graphically illustrated in the state diagram from FIG. 11 and has an inlet port 16*b* for explosive mixtures, an outlet port 16*a* for the combustion gases and a flush port 16*c*. One chamber (Roman numeral I in FIG. 11) is intended for compression, combustion and discharge (2-stroke cylinder) and one chamber (Roman numeral II in FIG. 11) is intended for sucking in, compression and transportation to the combustion chamber (2-stroke crankcase) via the flush port. In this embodiment, the rotary machine is provided with three port belts 15*a*-15*c* on a side of the rotor 2 and associated outlet ports 16*a*, inlet ports 16*b* and flush ports 16*c*.

The inlet port 16*b* can only be used by the inlet chamber II. After the flushing time, a vacuum is created due to the expansion and the suction chamber is filled with the combustion mixture via the inlet port 16*b*. As soon as the inlet chamber II has reached its maximum volume, the inlet port 16*b* closes and compression starts (squeeze). When the inlet chamber II has reached its smallest volume, the flush ports open and the combustion mixture is transported to the combustion chamber I.

The outlet port 16*a* can only be used by the combustion chamber I. As soon as the combustion chamber I has reached its maximum volume, it is filled with the combustion mixture via the flush ports 16*c*. Then, compression is effected until the smallest volume has been reached and ignition takes place. As a result of the combustion, the combustion chamber I expands until the outlet port 16*a* opens and the combusted mixture can escape. This happens just before the chamber I reaches its maximum volume. The outlet port 16*a* closes again at the maximum volume and the cycle starts again.

Figure 11:
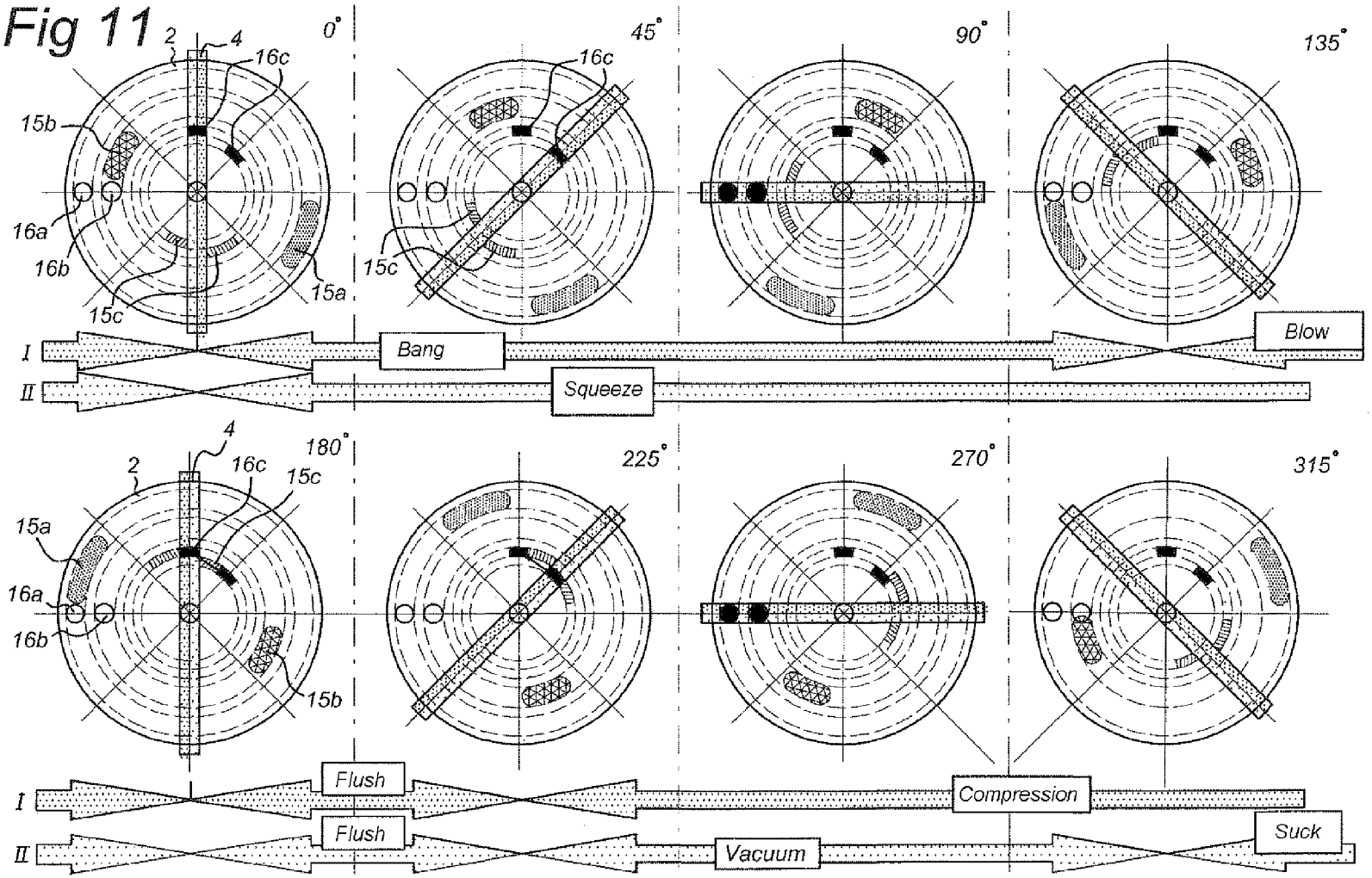
FIG. 11 shows a state diagram of compression, decompression and gas streams in a motor based on a rotary machine according to the present invention.

The complete configuration comprises a pair of chambers on each side of the rotor 2 and thus forms a kind of two-cylinder 2-stroke variant. FIG. 11 shows the state of the combustion chamber I and suction chamber II for every 45 degrees, i.e. for 0°, 45°, 90°, 135°, 180°, 225°, 270° and 315°. The following table contains a brief description. In this example, the position of the ports 16*a*-16*c* and the openings in the port belts 15*a*-15*c* are chosen such that ¾ of the revolution is used for expansion of the combustion chamber I and ¼ of the revolution for discharge.

| Position | Combustion chamber I | Suction chamber II |
|---|---|---|
| 000 | moment of combustion | inlet port closes |
| 045 | combustion - expansion | compression of combustion gas |
| 090 | combustion - expansion | compression of combustion gas |
| 135 | outlet port opens | compression of combustion gas |
| 180 | outlet port closes and flush port opens | flush port opens, transportation to the combustion chamber |
| 225 | filling received and flush port closes | flush port closes and vacuum starts |
| 270 | compression | vacuum |
| 315 | compression | inlet port opens and suction starts |
| 360 | → 000 | → 000 |

With conventional 2-stroke engines, the outlet port is also open during the flushing phase. In addition, the outlet port only closes after the flush port has closed and thus forms a potential leak. Using the present application, these situations can be prevented. Apart from the efficiency advantages of the STaR mechanism, this makes additional inlet and outlet optimization possible.

In a second variant, the rotary machine is used as a combustion engine with one working stroke per two revolutions. This application, which is graphically explained in the state diagram of FIG. 12, has an inlet port 16*b* for explosive mixtures and an outlet port 16*a* for the combustion gases. The inlet port 16*b* and outlet port 16*a* are used by both chambers I, II on one side of the rotor 2. The port belts 15*a*, 15*b* rotate at half the speed of rotation of the rotor 2. This is achieved, for example, by an external port belt 15*a*, 15*b* which rotates on the inside of the housing 8. Driving is effected, for example, by means of a gear wheel which is coupled to the rotor 2 and reduces by a factor 2. The two chambers I, II thus each have their own Suck-Squeeze-Bang-Blow (SSBB) cycle, as is customary with the current 4-stroke engines.

In an embodiment, the rotary machine is provided with two port belts 15*a*, 15*b* on one side of the rotor 2, which rotate about the first rotation axis 3 at half the angular speed of the rotor 2, and associated outlet ports 16*a* and inlet ports 16*b*.

The inlet port 16*b* is open for the entire inlet stroke (suck). Then a compression stroke (squeeze) takes place which is followed by the ignition and the combustion stroke (bang). The outlet port 16*a* opens and the combustion gases are driven out (blow) and the cycle is closed.

Figure 12:
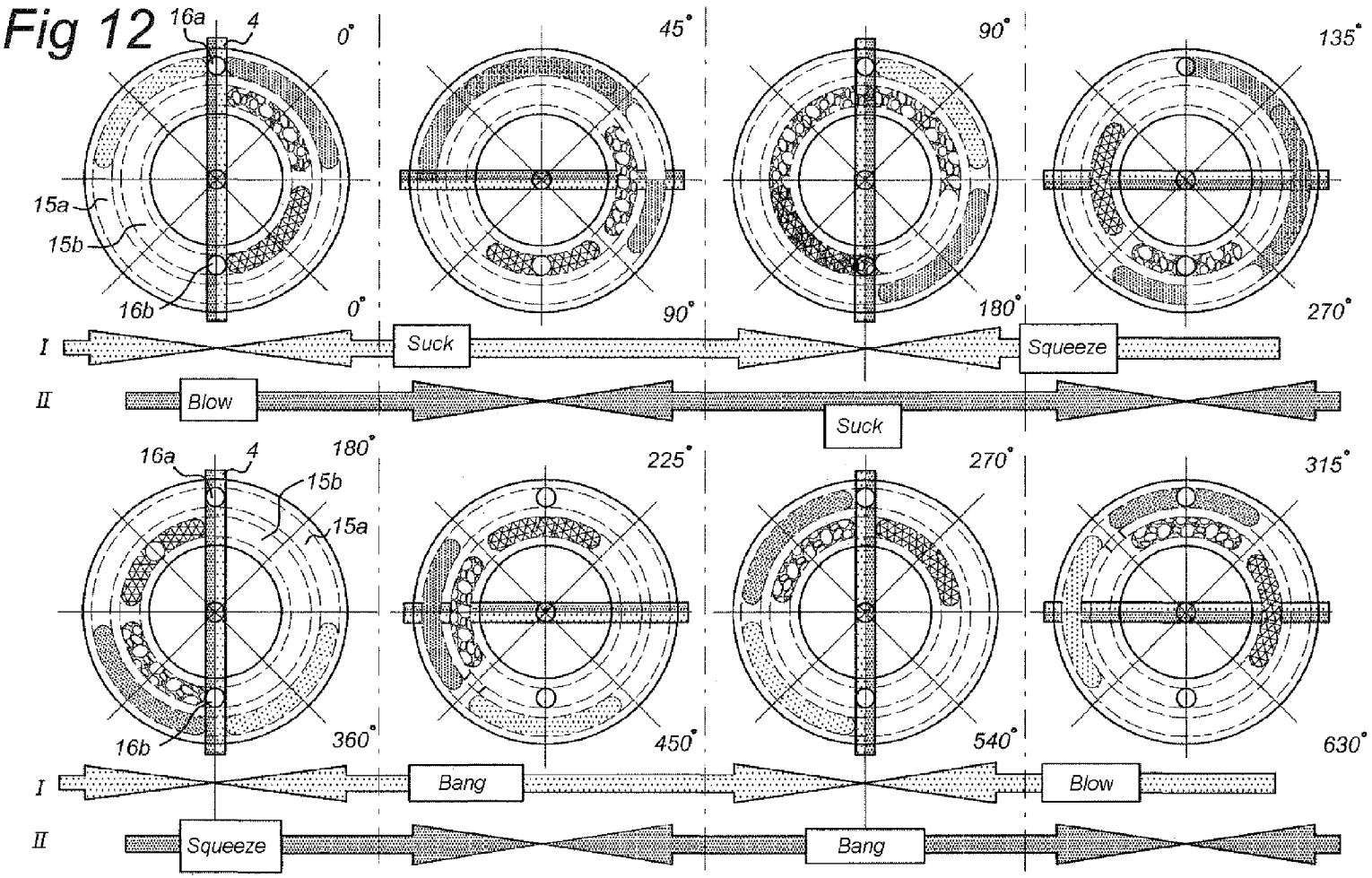
FIG. 12 shows a state diagram of compression, decompression and gas streams in an alternative motor based on a rotary machine according to the present invention.

The complete configuration comprises a pair of chambers I, II on each side of the rotor and thus forms a kind of four-cylinder 4-stroke variant. FIG. 12 shows the situation for every 90 degrees of the rotor 2 (i.e. for each 45 degrees of the port belt 15*a*, 15*b*). The following table provides a brief description.

| Position | Chamber I | Chamber II |
|---|---|---|
| 000 | end of Blow - start of Suck | Blow |
| 090 | Suck | end of Blow - start of Suck |
| 180 | end of Suck - start of Squeeze | Suck |
| 270 | Squeeze | end of Suck - start of Squeeze |
| 360 | end of Squeeze - start of Bang | Squeeze |
| 450 | Bang | end of Squeeze - start of Bang |
| 540 | end of Bang - start of Blow | Bang |
| 630 | Blow | end of Bang - start of Blow |
| 720 | → 000 | → 000 |

The present invention has been described above with reference to the drawings by means of exemplary embodiments. The description and drawings should be considered as illustrative of the possible embodiments and not as a limitation of the intended scope of protection.

Further variations of the described embodiments are possible and will be clear to experts in the technical field who can implement the present invention after reading and studying the text and drawings.

The invention claimed is:

1. A rotary machine for compression and decompression, comprising;

a disc-shaped rotor having a first rotation axis which is at right angles to a plane of the disc-shaped rotor and is situated in an orientation plane;

a substantially disc-shaped swing element having a second rotation axis which is situated in a plane of the substantially disc-shaped swing element and in the orientation plane, wherein the second rotation axis makes an angle with the first rotation axis in the orientation plane;

a substantially spherical housing which surrounds the disc-shaped rotor and the substantially disc-shaped swing element and, in combination therewith, forms four chambers;

a connecting body which positions the disc-shaped rotor and the substantially disc-shaped swing element slidably with respect to one another in the housing, and seals the four chambers;

wherein the rotary machine is furthermore provided with a power drive and a mechanical connection between the power drive and the disc-shaped rotor, wherein the power drive is configured to deliver power to the rotary machine or to take off power from the rotary machine, wherein the rotary machine furthermore comprises one or more ports in the housing for each chamber.

2. The rotary machine of claim 1, wherein the power drive is configured to drive the disc-shaped rotor.

3. The rotary machine of claim 1, wherein a working fluid is delivered to the one or more ports and the power drive is configured to take off power from the rotary machine.

4. The rotary machine of claim 1, furthermore comprising a port belt which is rotatably accommodated with respect to the housing and comprises slots which correspond to the one or more ports in the housing.

5. The rotary machine of claim 4, wherein the port belt has a mechanical connection with the disc-shaped rotor.

6. The rotary machine of claim 4, wherein the port belt has a mechanical connection with the substantially disc-shaped swing element.

7. The rotary machine of claim 1, provided with three port belts on one side of the disc-shaped rotor and the one or more ports.

8. The rotary machine of claim 1, provided with two port belts on one side of the disc-shaped rotor which are configured to rotate about the first rotation axis at half the angular speed of the disc-shaped rotor and the one or more ports.

9. The rotary machine of claim 1, wherein the connecting body is a substantially cylindrical body having a longitudinal axis, wherein the connecting body is provided with a slot-shaped opening for slidably accommodating the substantially disc-shaped swing element therein, and with an outer surface which is coaxial with the longitudinal axis adjoining the disc-shaped rotor, wherein the longitudinal axis of the connecting body is situated in the plane of the disc-shaped rotor.

10. The rotary machine of claim 1, wherein the disc-shaped rotor is provided with a rectangular opening in which the connecting body is accommodated so as to be movable.

11. The rotary machine of claim 1, wherein the disc-shaped rotor is provided with a substantially hourglass-shaped opening in which the connecting body is accommodated so as to be movable.

12. The rotary machine of claim 1, wherein the angle is smaller than 80°.

13. The rotary machine of claim 1, wherein the angle is adjustable by displacing the second rotation axis.

14. The rotary machine of claim 1, wherein the chambers are provided with volume-reducing elements.

15. The rotary machine of claim 1, wherein the shape of the substantially spherical housing is flattened along the second rotation axis.

16. The rotary machine of claim 1, wherein the connecting body and the substantially disc-shaped swing element form one integrated swing element.

17. The rotary machine of claim 1, wherein the connecting body and the disc-shaped rotor form one integrated rotation element.

18. The rotary machine of claim 1, wherein the rotary machine furthermore comprises a generator.

19. The rotary machine of claim 18, wherein one or more elements of the generator are integrated with the rotary machine.

20. The rotary machine of claim 18, wherein the generator comprises a stator part and a rotor part, wherein the rotor part is driven via the rotor, and the stator part is attached to the housing of the rotary machine.

21. A method for operating a rotary machine for compression and decompression, comprising;

a disc-shaped rotor having a first rotation axis which is at right angles to a plane of the disc-shaped rotor and is situated in an orientation plane;

a substantially disc-shaped swing element having a second rotation axis which is situated in a plane of the substantially disc-shaped swing element and in the orientation plane, wherein the second rotation axis makes an angle with the first rotation axis in the orientation plane;

a substantially spherical housing which surrounds the disc-shaped rotor and the substantially disc-shaped swing element and, in combination therewith, forms four chambers;

a connecting body which positions the disc-shaped rotor and the substantially disc-shaped swing element slidably with respect to one another in the housing, and seals the four chambers;

wherein the rotary machine is furthermore provided with a power drive and a mechanical connection between the power drive and the disc-shaped rotor, wherein the power drive is configured to deliver power to the rotary machine or to take off power from the rotary machine, wherein the rotary machine furthermore comprises one or more ports in the housing for each chamber, the method comprising at least one of taking off power from the rotary machine or delivering power to the rotary machine via the disc-shaped rotor.

* * * * *